US007228704B2

(12) United States Patent
Rand et al.

(10) Patent No.: US 7,228,704 B2
(45) Date of Patent: Jun. 12, 2007

(54) DRAWER REFRIGERATION UNIT

(75) Inventors: Thomas W. Rand, Cedarburg, WI (US); Andrew J. Doberstein, Hartford, WI (US); Joseph E. Braun, Milwaukee, WI (US)

(73) Assignee: U-Line Corporation, Milwaukee, WI (US)

( * ) Notice: Subject to any disclaimer, the term of this patent is extended or adjusted under 35 U.S.C. 154(b) by 199 days.

(21) Appl. No.: 11/068,197

(22) Filed: Feb. 28, 2005

(65) Prior Publication Data

US 2006/0191285 A1 Aug. 31, 2006

(51) Int. Cl.
*F25D 25/02* (2006.01)

(52) U.S. Cl. ..... 62/382; 62/408

(58) Field of Classification Search ..... 62/186, 62/382, 407, 442, 446, 448, 203, 302, 441; 312/236, 330.1

See application file for complete search history.

(56) References Cited

U.S. PATENT DOCUMENTS 2,432,397 A * 12/1947 Guyon ..... 62/258
2,450,844 A * 10/1948 Stuart ..... 62/382
2,498,402 A * 2/1950 Guyon ..... 312/351
2,592,233 A * 4/1952 Atchison ..... 62/284
2,734,351 A * 2/1956 Stewart ..... 62/450
3,199,579 A * 8/1965 Foster et al. ..... 165/48.1
3,364,695 A * 1/1968 Saunders et al. ..... 62/382
5,120,118 A * 6/1992 Rankin ..... 312/402
5,277,039 A 1/1994 Haasis
5,641,217 A * 6/1997 Caruso et al. ..... 312/404
6,446,459 B1 9/2002 Sawhney et al.
6,447,083 B1 9/2002 Chiapetta et al.
6,449,976 B1 9/2002 Chai et al.

FOREIGN PATENT DOCUMENTS

JP 11-211317 A * 8/1999
JP 2003-65665 A * 3/2003

OTHER PUBLICATIONS

Sub-Zero Freezer Company, Inc.; 700BC Combination Drawers; webpages from www.subzero.com; Copyright 2005 Sub-Zero Freezer Company, Inc.; not admitted prior art.

* cited by examiner

*Primary Examiner*—Mohammad M. Ali
(74) *Attorney, Agent, or Firm*—Quarles & Brady LLP

(57) ABSTRACT

A drawer refrigeration unit provides two distinct zones of cooling in a single cabinet for two pull-out drawers. The refrigeration system includes an evaporator, a compressor and a condenser. The single evaporator system is aided by a damperless air circulation system to maintain the temperature zones at a temperature differential that is at least 10 degrees Fahrenheit. The present invention can thus be used as a combination refrigerator and freezer drawer unit using only one evaporator in a cross-ventilated cabinet.

24 Claims, 7 Drawing Sheets

DRAWER REFRIGERATION UNIT

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

1. Technical Field

The present invention relates to refrigerated food and drink storage units, and in particular, to compact drawer refrigeration units in which the storage space is defined by one or more pull-out drawers.

2. Description of the Related Art

Refrigerators and freezers for the cold storage of food and beverage items are well known. Many conventional units have one or more doors that are hinged to the front side of the cabinet. Food and beverages are ordinarily stored on shelves in the cabinet and the door(s) as well as in slide-out crisper drawers near the bottom of the cabinet. This is common for industrial and residential refrigerators as either full-size standup units or compact, under-counter units.

Drawer refrigerators are also well known in which the doors are replaced by pull-out drawers having bins in which the food is stored. Drawer refrigerators can be preferred in certain applications, such as low, under-counter applications, because the food items can be pulled out away from surrounding cabinets and accessed more easily. Often such drawer refrigerators have two, or possibly more, pull-out drawers that are arranged side by side or vertically stacked one above the other so that not all of the items are stored in the same drawer.

One problem with drawer refrigerators is that the drawers share a common interior, and thus it is difficult to control the temperature of each drawer, either to set each drawer at the same temperature or to prescribed different temperatures. It is difficult, therefore, to achieve two disparate temperature zones in the same unit, such as would be required for a unit having a freezer drawer and a non-freezer drawer in single cross-ventilated cabinet.

This problem can be avoided largely by isolating each drawer and using two separate evaporator assemblies for each drawer, but at considerable expense. Alternatively, the refrigerator can have a single evaporator, likely at the bottom of the unit, and a dampening system, such as movable louvers. Again, however, this adds considerable expense to the unit as well as occupies additional space in the interior which could otherwise be used for cold storage.

Accordingly, a drawer refrigeration unit is desired that has improved control of the temperature in each zone without requiring each drawer to be completely isolated or independently cooled.

SUMMARY OF THE INVENTION

The present invention is a compact drawer type refrigeration unit for the cold storage of food and beverages. Its refrigeration system uses one evaporator to cool at least two zones, in the cabinet in which the drawers are mounted, to different temperatures such that each drawer can be used for different cooling and storage needs. For example, the unit can have one drawer in a refrigerator zone for cooling food and beverages without freezing and another drawer in a freezer zone for storing frozen goods and ice.

Specifically, in one aspect the invention provides a drawer refrigeration unit having a cabinet defining an interior chamber with at least two drawer cavities in each of which is mounted a drawer. The unit's refrigeration system has only one evaporator mounted inside the cabinet in one of the drawer cavities, and an air circulation system transfers air between the cavities to maintain one temperature zone in one of the cavities and another temperature zone in another cavity. The drawer unit can maintain a temperature differential between the two zones of at least 10 degrees Fahrenheit (° F.).

The invention thus provides a slidable drawer refrigeration unit in which the drawers are stacked vertically or arranged side by side and can be pulled from the cabinet to open and close an associated portion of the cabinet for access to the items stored therein.

The refrigeration and circulation system permit the unit to sustain disparate temperatures in a single cabinet of drawers. It can be used thus be used for items that are best stored in different temperature environments. For example, the drawer unit could be a beverage center in which one drawer holds wines, which are best kept at above about 45° F., and the another holds beer or soft drinks, which are best kept at about 35° F. Or, the drawers could hold complementary items, such wine in one drawer and cheese and meets in another drawers which are best kept at just above freezing (about 33° F.).

In another preferred aspect, the invention can provide a drawer refrigerator/freezer. The evaporator maintains both a refrigerator zone where the temperature is above the freezing point of water and a freezer zone where the temperature is below the freezing point of water. The two (or more) drawers slidably mount to the cabinet in the drawer cavities such that one can store refrigerated items and one can store frozen items. The evaporator preferably maintains the refrigerator zone between 33° F. and 45° F. and the freezer zone between about −10° F. and 10° F., with a preferable temperature differential between 30–40° F.

The air circulation system can include a fan that aids in circulating air between the cavities. The evaporator can be mounted inside the cabinet in one of the drawer cavities, for example a lower drawer cavity defining the freezer zone. The fan works to circulate the air in one zone throughout its drawer cavity and also through to the other drawer cavity. By properly controlling the air flow and cooling cycles, the disparate temperature zones can be maintained using a single evaporator and without the need to actively or passively dampen communication between the zones.

Another aspect of the invention is a drawer type refrigeration unit having a built-in ice maker. The ice maker could be of the conventional tray type make or a it could be a clear ice cascading type. In any event, the ice maker would be mounted to the cabinet in the freezer zone. An ice bin can be set in the associated drawer catch the ice from the maker. The bin could then be pulled out with the drawer for easy access to the ice.

These and still other advantages of the invention will be apparent from the detailed description and drawings. What follows are one or more preferred embodiments of the present invention. To assess the full scope of the invention the claims should be looked to as no one embodiment is intended to fully set forth the scope of the invention.

DETAILED DESCRIPTION OF THE PREFERRED EMBODIMENT(S)

Figure 1:
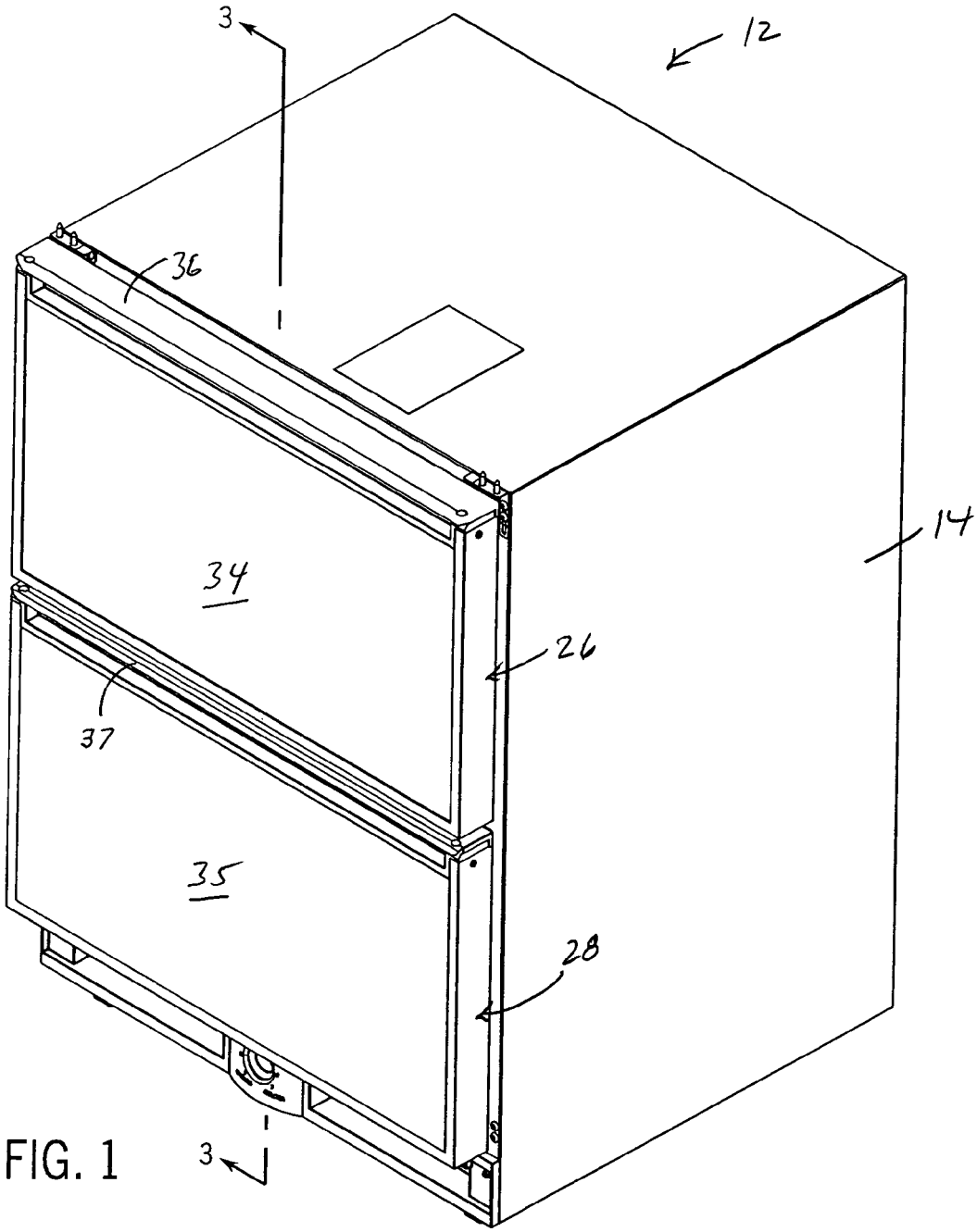
FIG. 1 is a perspective view of a multi-zone drawer refrigeration unit of the present invention.
Figure 2:
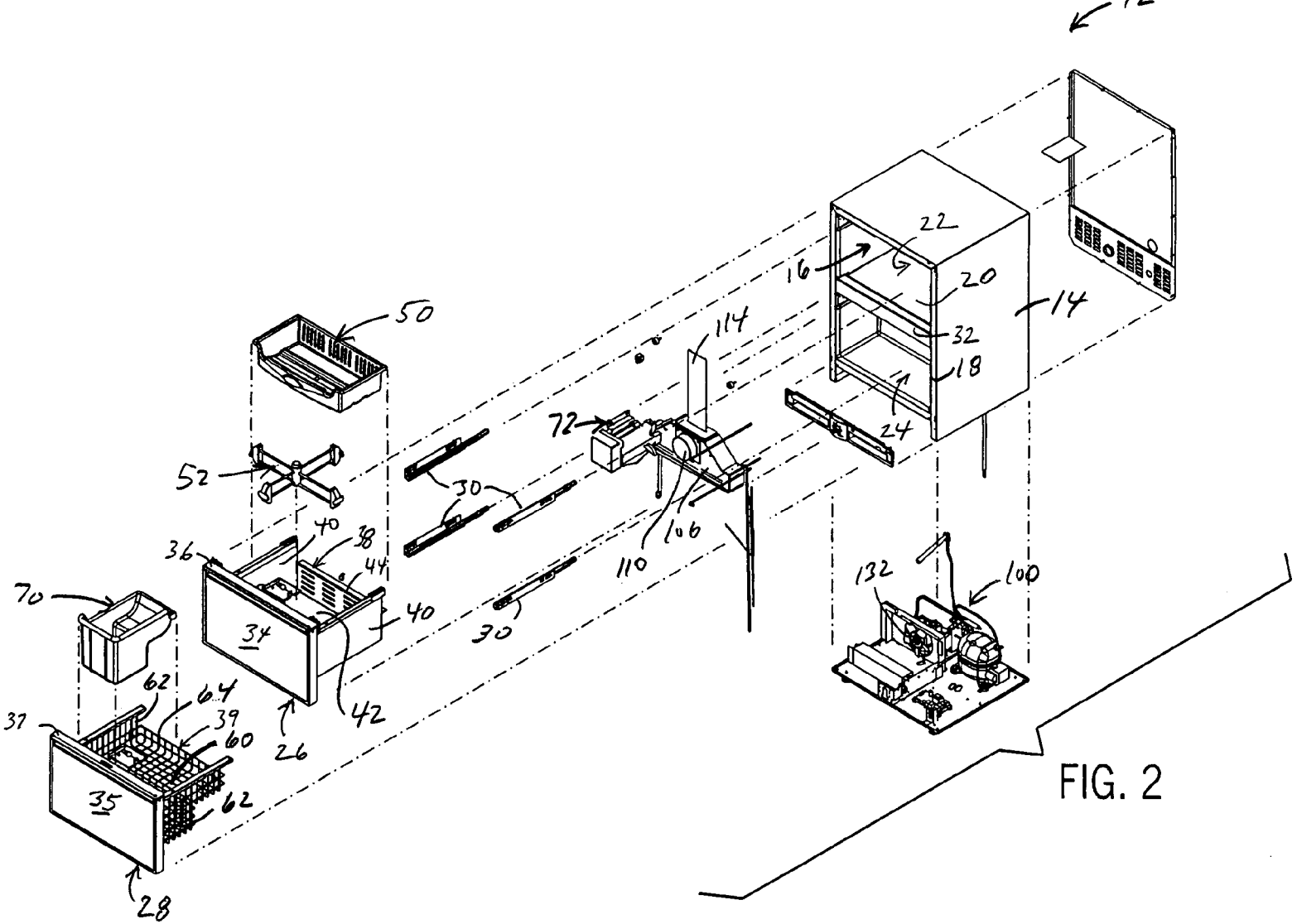
FIG. 2 is an exploded perspective view thereof.
Figure 3:
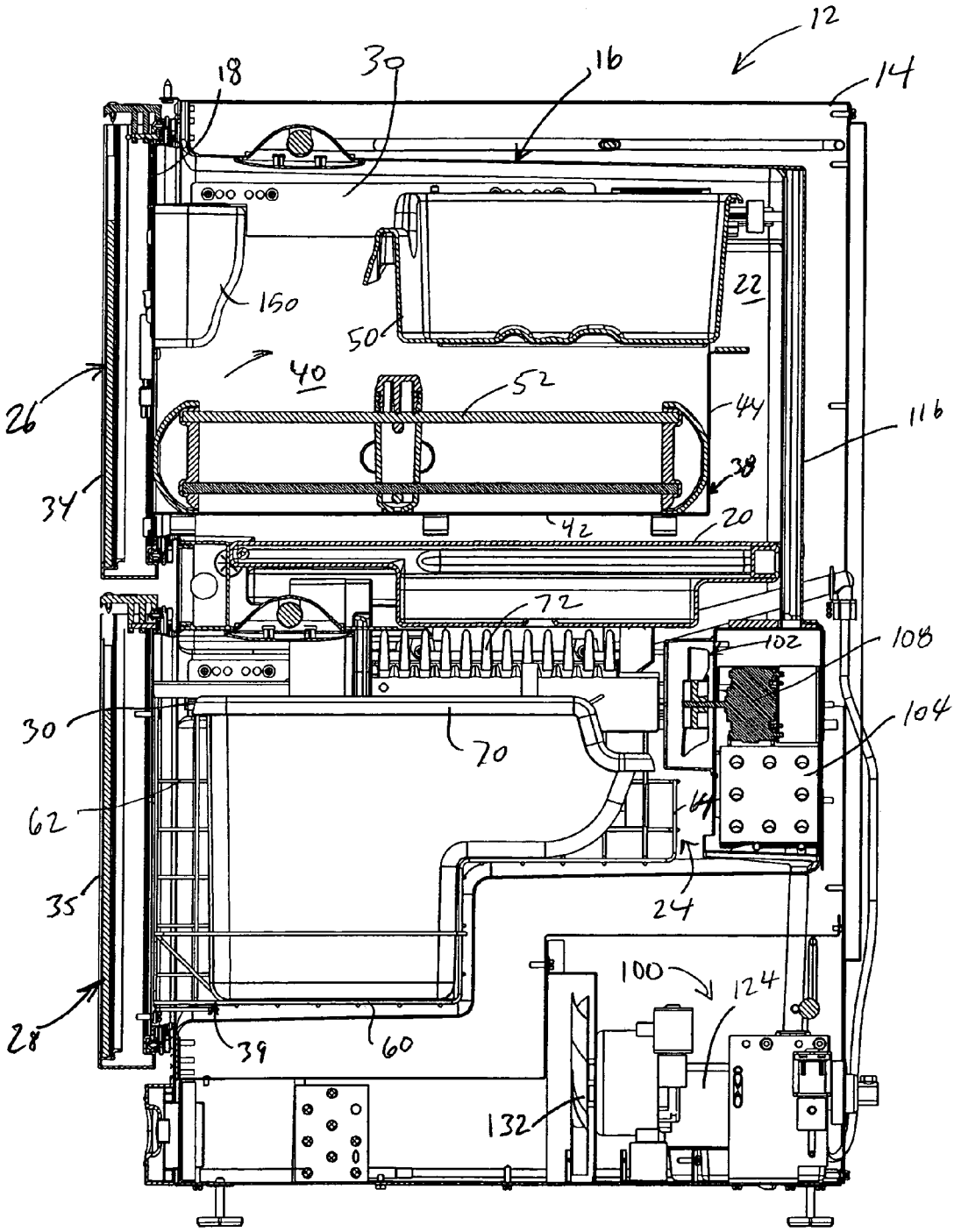
FIG. 3 is a side sectional view taken along line 3—3 of FIG. 1.
Figure 4:
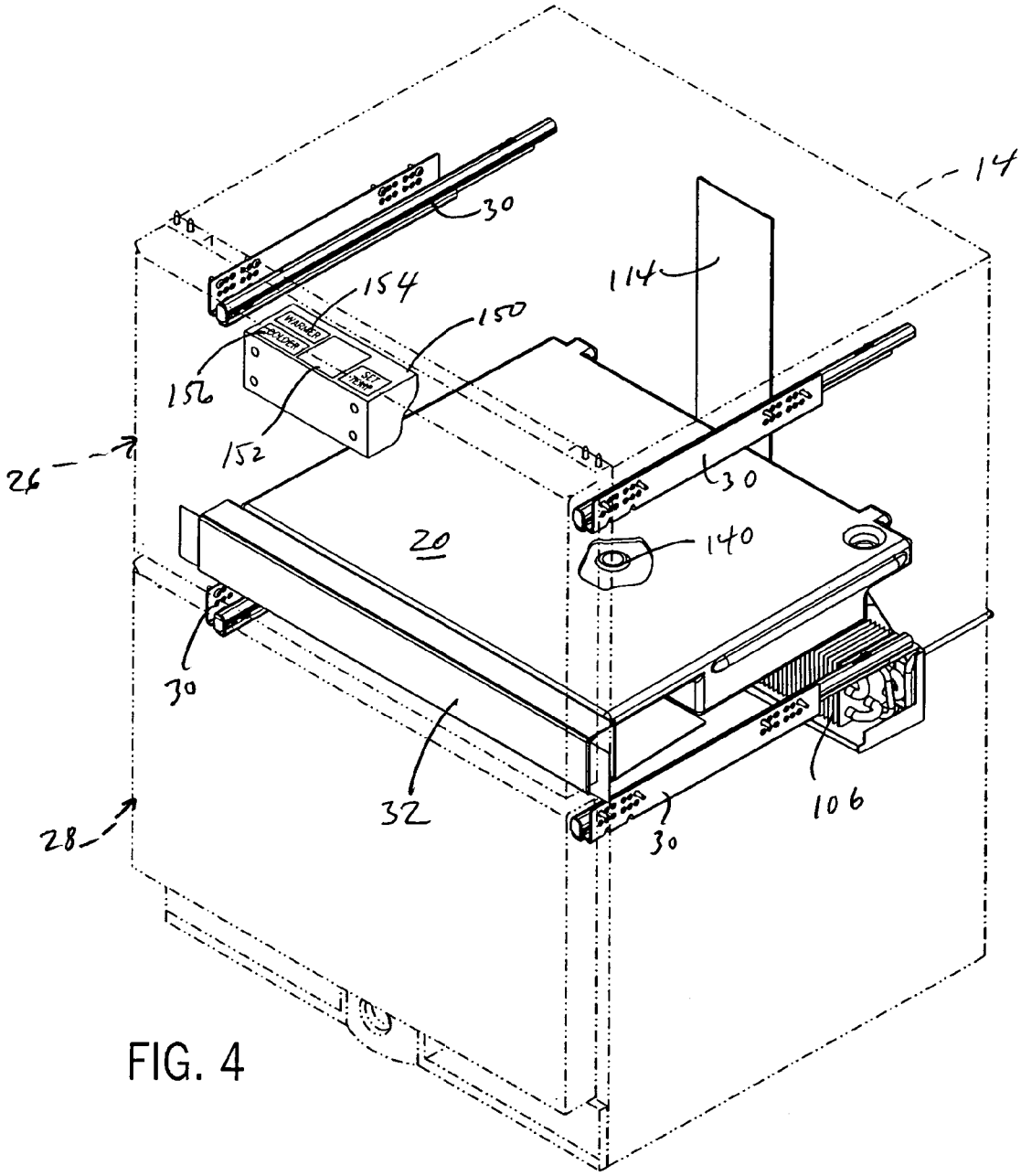
FIG. 4 is a perspective view showing the interior of the cabinet with the exterior of the cabinet and drawers shown in phantom.

The present invention generally provides a refrigerated cabinet of drawers for cold storing items, primarily food and beverages. The cabinet holds two or more drawers that can be pulled in and out of the cabinet to access the stored items. The cabinet can mount the drawers in a vertically stacked arrangement or horizontally side-by-side. While the cabinet could hold more than two drawers, it has been found that for many under-counter installations two vertically stacked drawers are preferable.

Cooling and circulation systems allow multiple temperature zones to be established and maintained inside the cabinet. Preferably, each temperature zone is associated with one of the pull-out drawers such that each drawer can provide item-specific cold storage. The temperature differential between the temperature zones, and the range of temperatures in each zone, are designed to be in a range this is both controllable and suited to the items stored in the associated drawers. The drawer unit can thus be used for varied applications depending on the temperature at each zone. The cooling and circulation systems are readily capable of maintaining temperature differentials in the range of 10° F. to 50° F. between two adjacent zones. Although it may be possible to achieve, it is more difficult to control and generally unnecessary to have temperature differentials too far outside of this range.

The drawer unit can provide disparate temperature zones that are either all above, all below, or one or more above and one or more below the freezing point of water. One exemplary application of the drawer unit is as a beverage center. It has been found that soda and beer, for example, are usually best kept at a temperature slightly above freezing, for example 35° F. However, wines are best stored at temperatures ranging from 45° F. to 60° F. depending on the variety. Thus, with the present invention, a single under-counter cabinet can have both a wine drawer and a soda/beer drawer with each beverage type being appropriately cooled. Another example could be a drawer unit for entertaining guests which has one drawer of wine bottles and another which stores meats and cheeses, which are best kept at near freezing, or about 33° F. Likely the most common application for the drawer unit would be as a two drawer refrigerator/freezer unit. As such, the drawings and following text describes one preferred version of such in detail.

Referring now to FIGS. 1–4 and 6, a preferred under-counter mounted, vertically stacked drawer refrigerator/freezer 12 includes a cabinet 14 defining an internal chamber 16 open at a front opening 18. The chamber 16 is divided vertically by a partition 20 into two vertically aligned drawer cavities 22 and 24 in which are mounted two drawers 26 and 28, respectively, by suitable slide mechanisms 30 mounted to the inside of the cabinet 14. In the preferred refrigerator/freezer 12 shown in the drawings, the upper drawer 26 is a refrigerator drawer and the lower drawer 28 is a freezer drawer because a refrigerator temperature zone is present in drawer cavity 22 and a cooler freezer temperature zone is present in drawer cavity 24.

The cabinet 14, partition 20 and the drawers 26 and 28 are formed of inner and outer members, of molded plastic or formed metal, with the space therebetween filled with foam insulation as known in the art. A mullion 32 extends across the front opening 18 between the drawers 26 and 28 to support the front edge of the partition 20, which is suitably supported at its side and back edges as well. The mullion 32 can be heated by a low wattage surface heater (not shown) to remove any condensation that may occur during operation.

Each of the drawers 26 and 28 have a front door panel 34 and 35 with a handle 36 and 37 along a top edge. Attached to the door panels 34 and 35 are drawer bins 38 and 39. The drawer bins 38 and 39 can be of the same construction or they may be item-specific in which they are constructed to accommodate a particular item or group of items.

In the preferred drawer refrigerator/freezer 12 shown in the drawings, the refrigerator drawer 26 has opposite side walls 40 joined at their bottom edges to a bottom wall 42 and at their back edges by a vented rear wall 44 that extends only about half the height of the side walls 40 so that its top edge is set down from the top edges of the side walls 40. The low rear wall 44 makes room for a removable bin 50 to be slid forward and backward along the top edges of the side walls 40. The lower space in the refrigerator drawer bin 38 can be partitioned using an adjustable divider fence 52. The slidable bin 50 and the divider fence 52 are described in detail in co-pending U.S. application Ser. No. 10/665,835, filed on Sep. 19, 2003, and assigned to the assignee of the present invention. The corresponding portions of that application are hereby incorporated by reference as though fully set forth herein.

The freezer drawer 28 has a wire basket drawer bin 39 with a stepped bottom 60 that makes the bin 39 shallower at the back end. Stepped sides 62 and a short back 64 define the periphery of the bin 39. The freezer drawer 28 preferably holds an ice bin 70 which has a stepped bottom nested in the drawer bin 39 below an ice maker 72, which is mounted to a side wall at the interior of the cabinet in the freezer drawer cavity 24. The ice maker 72 can be any suitable conventional standard or clear automated ice maker, such as that disclosed in U.S. Pat. No. 4,872,317, the entire disclosure of which is incorporated by reference. The ice maker 72 is connected to a water supply line and as it produces ice the "cubes" fall and are collected in the ice bin 70. The ice bin 70 moves with the freezer drawer 28 so that the ice cubes can be accessed easily.

Figure 5:
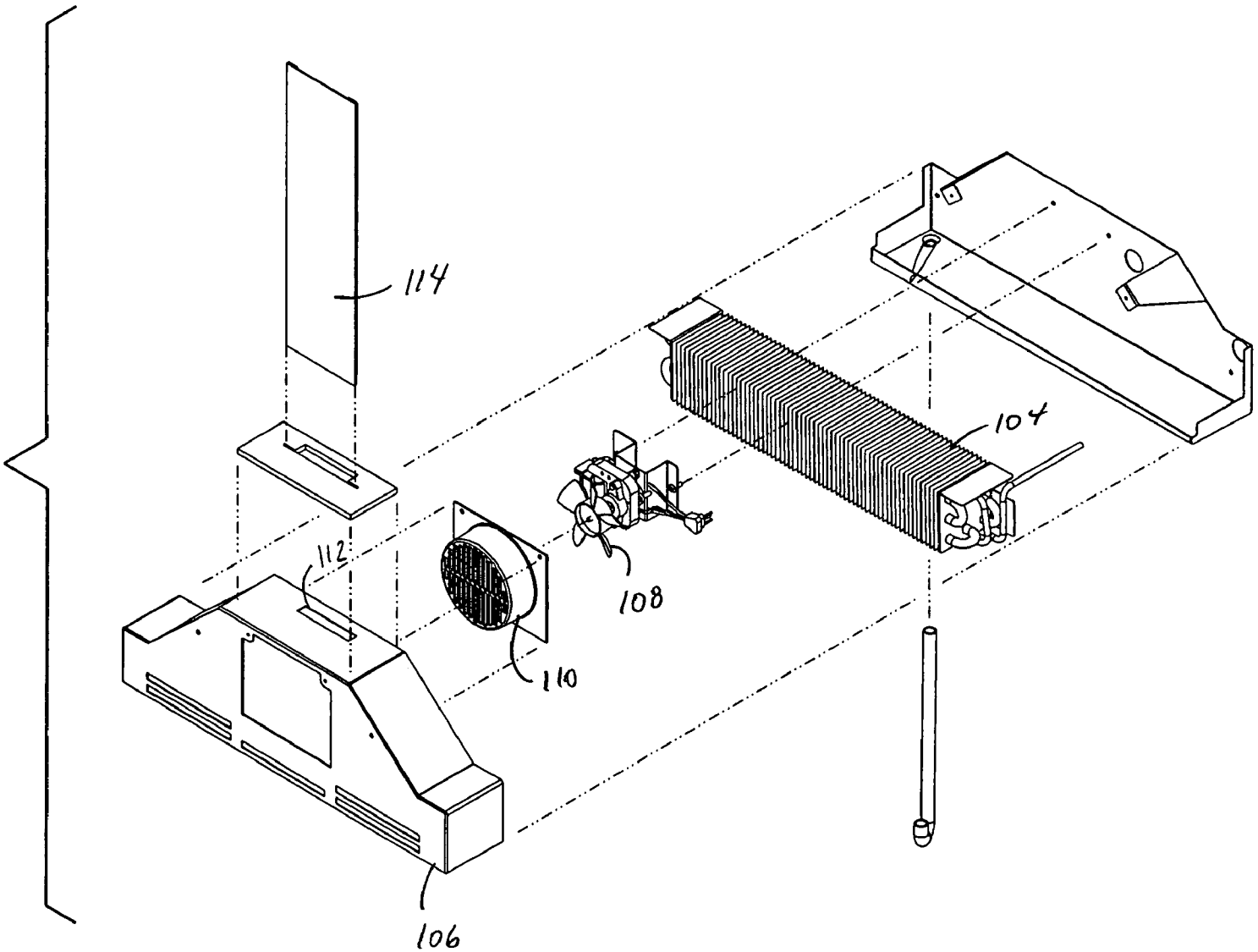
FIG. 5 is an exploded view showing an evaporator and air circulation assembly.
Figure 6:
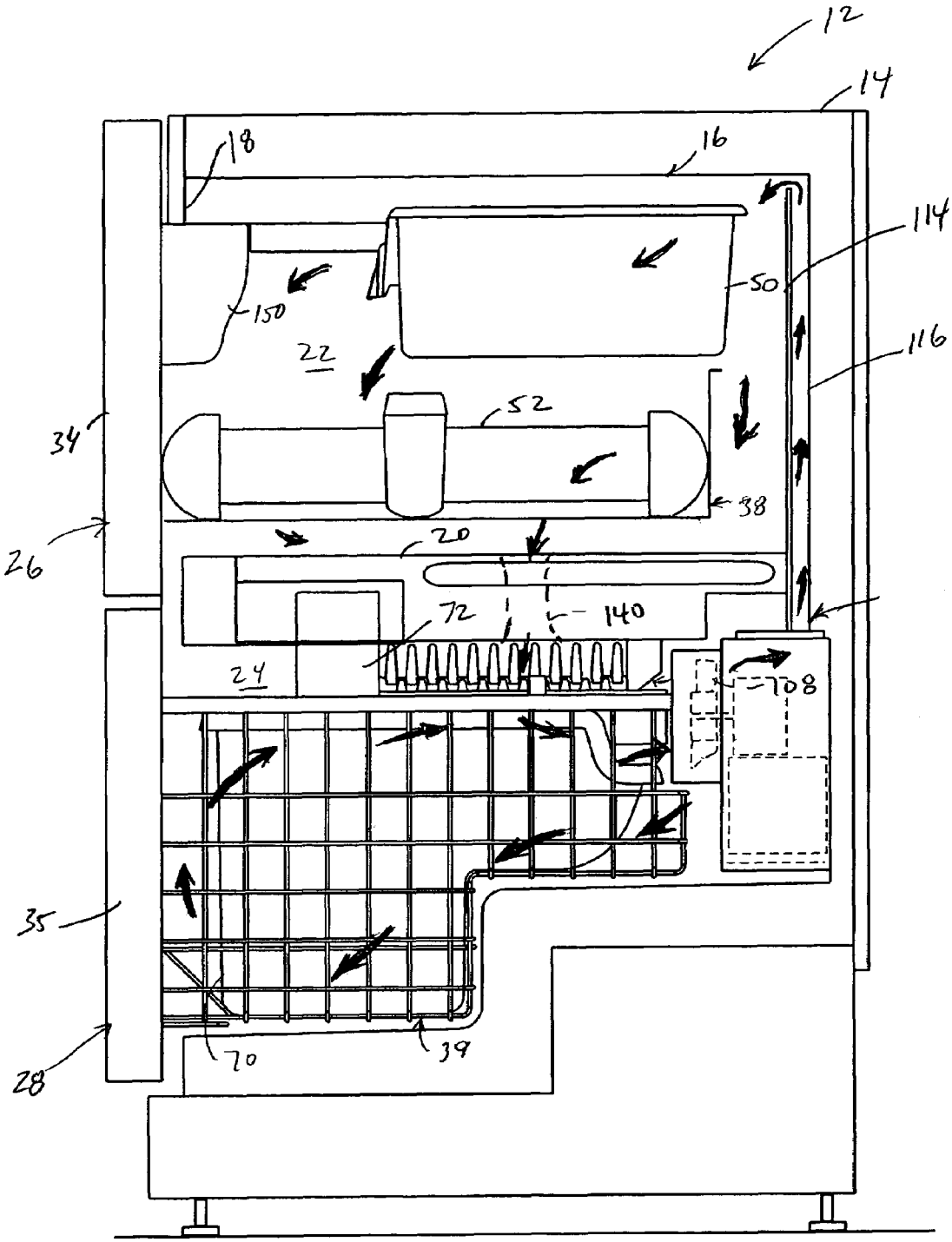
FIG. 6 is a diagrammatic representation of the inside of the cabinet with arrows representing the air flow through the interior of the cabinet.
Figure 7:
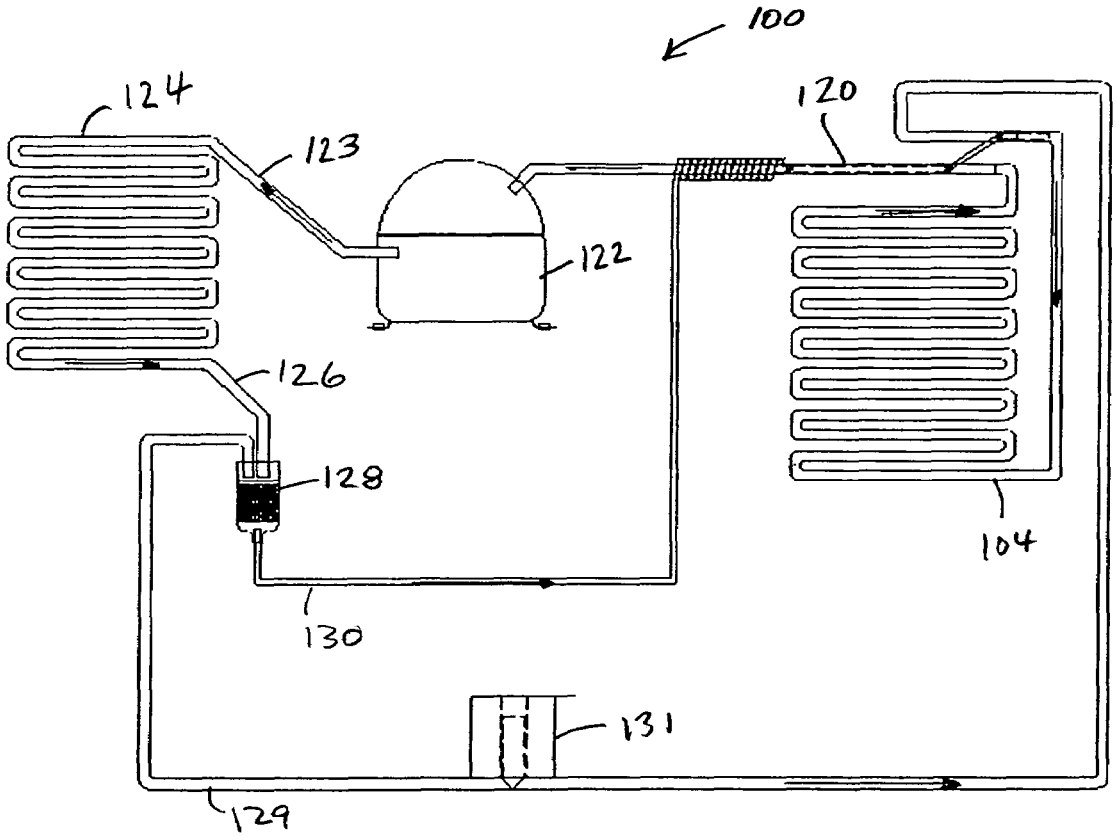
FIG. 7 is a schematic diagram of the refrigeration system.

Turning now to FIGS. 5–7, the drawer refrigerator/freezer 12 is cooled by a refrigeration system 100 and air is circulated through the interior of the cabinet 14 by an air circulation system 102 in a controlled manner to achieve and sustain the disparate temperatures of the refrigerator and freezer temperature zones.

The refrigeration system 100 has a frost-free evaporator 104 within a housing 106 which is mounted in the interior of the cabinet 14 at the rear of the freezer drawer cavity 24. A circulation fan 108 is also mounted in the housing 106 between an air duct 110 and the evaporator 104. The upper part of the housing 106 has an opening 112 where an upright chimney 114 is mounted to define a vertical air channel at an interior rear wall 116 of the cabinet 14.

The evaporator 104 has an outlet line 120 which passes gas refrigerant to a compressor 122. The output line 123 of the compressor 122 is connected to the inlet of a condenser 124 having an outlet line 126 connected to a dryer 128. A small diameter capillary tube 130 leads from the dryer 128 to an inlet of the evaporator 104. The compressor 122 draws refrigerant from the evaporator 104 and discharges the refrigerant under increased pressure and temperature to the condenser 124. The hot refrigerant gas entering the condenser 124 is cooled by a condenser fan 132 (see FIGS. 2 and 3). As the temperature of the refrigerant drops under substantially constant pressure, the refrigerant in the condenser 124 liquefies. The restricted diameter capillary tube 130 maintains the high pressure in the condenser 124 and at the compressor outlet while providing substantially reduced pressure in the evaporator 104. This reduced pressure results in a large temperature drop and subsequent absorption of heat by the evaporator 104. The compressor 122, condenser 124, and condenser fan 132 are located at the bottom of the cabinet 14 beneath the insulated portion thereof (see FIG. 2) which defines the cooled space.

Since the evaporator 104 is disposed in a freezer zone, the refrigeration system includes a defrost cycle in which relatively warm refrigerant is passed through the evaporator 104, which allows it to thaw and clear off any accumulated frost. In this case, a hot gas bypass line 129 runs between the drier 128 and the inlet of the evaporator 104, being in communication with the compressor outlet 123 through the condenser 124. During a defrost cycle, the condenser fan 132 is inactivated so that the hot compressed gas in the condenser 124 is not cooled or liquefied. A normally closed solenoid valve 131 in the bypass line 129 opens so that the evaporator 104 receives the hot gas through the bypass line 129, rather the cooled liquid refrigerant than the capillary tube 130. The hot gas warms the evaporator 104 for a prescribed time period to clear any frost build-up. The evaporator housing 106 acts to shield the heat and minimize warming of the freezer zone during the defrost cycle.

The refrigeration 100 and air circulation 102 systems introduce cooled air into each of the drawer cavities 22 and 24 and are electronically controlled to maintain the associated disparate temperature refrigerator and freezer zones. Because the evaporator 104 is mounted in the freezer drawer cavity 24 the cool the freezer zone will be cooled first and will be maintained at a cooler temperature. The insulated partition 20 divides the interior of the cabinet in two and confines most of the cold air to the freezer drawer cavity 24. Although not necessary, having the colder freezer zone at the bottom of the cabinet aids in keeping the freezer zone cooler due to the fact that relatively warm air is lighter and tends to rise.

As shown in FIG. 6, the circulation fan 108 circulates the chilled air from the evaporator 104 into the freezer zone in the freezer drawer cavity 24. It also moves the air up through the chimney 114 to the refrigerator zone in the refrigerator drawer cavity 22. The vented rear walls of the bin 50 and the refrigerator drawer bin 38 allow cool air to better reach the items therein. The incoming cool air forces an equal volume of air through a return opening 140, which is about a 1 inch in diameter hole near the front part of the partition 20, back into the freezer drawer cavity 24. This warmer return air is distributed through the freezer zone and a cool cycle can be initiated to maintain the temperature of the freezer zone as needed.

The refrigerator drawer cavity 22 is cooled by the circulation of the cold air from the freezer zone. The flow of air between the zones is controlled in that it is directed through only the chimney 114 and the return opening 140, and also in that the operation of the circulation fan 108 is controlled. The air flow between the zones is not controlled other than this, and since there are no active or passive dampers that would entirely close off communication between the zones, the zones are in communication with one another at all times, which permits migration of air between the zones within acceptable limits.

A temperature differential between the zones of at least a 10° F. and up to at least a 50° F. can be achieved and sustained by properly controlling the refrigeration and circulation systems. The evaporator preferably maintains the refrigerator zone between about 33° F. and 60° F. and the freezer zone between about −10° F. and 10° F. When used as a general purpose refrigerator/freeze drawer unit, the refrigerator zone is more preferably held between about 34° F. and 45° F. and the freezer zone is more preferably held between about −4° F. and 7° F., with a temperature differential of 38° F., or at least between about 30–40° F. Only when storing special items should either zone need to exceed these ranges, such as when storing bottles of wine.

The refrigeration and circulation systems are operated and controlled by a control unit mounted in the basement of the cabinet 14 outside of the cooled space. A user control 150 mounted inside the refrigerator drawer 26 (best shown in FIG. 4) is used to interface with the control unit. The control 150 can have an LED display 152 providing actual and set temperature readings in each zone and temperature adjustment buttons, preferably in the form of warmer 154 and cooler 156 sealed buttons. The control 150 is used to set the desired temperature for each zone, if necessary to change from the factory default settings, after which the control unit cycles the cooling and air flow systems to maintain the set temperatures within a prescribed temperature variance from the set temperature. The control unit also controls the flow of supply water to the ice maker and can provide the user or service technician visual indication of refrigeration error conditions or cycle status.

It should be appreciated that merely one or more preferred embodiments of the invention have been described above. However, many modifications and variations to the preferred embodiment(s) will be apparent to those skilled in the art, which will be within the spirit and scope of the invention. Therefore, the invention should not be limited to the described embodiment(s). To ascertain the full scope of the invention, the following claims should be referenced.

We claim:

1. A drawer refrigeration unit, comprising:

a cabinet defining an interior chamber divided into first and second drawer cavities;

a first drawer slidably mounted to the cabinet in the first drawer cavity;

a second drawer slidably mounted to the cabinet in the second drawer cavity;

a refrigeration system including an evaporator mounted within the interior chamber, a compressor receiving return refrigerant from the evaporator and a condenser coupled to the compressor and to the evaporator through a restriction; and an air circulation system within the interior chamber for communicating air between the first and second drawer cavities;

wherein the first cavity has a first temperature zone and the second cavity has a second temperature zone at a temperature differential of at least 10 degrees Fahrenheit (° F.);

wherein the cabinet includes a partition between the first and second drawer cavities;

wherein the air circulation system has a circulation path formed by a chimney and a return path for communicating air between the first and second drawer cavities formed by an opening in the partition.

2. The unit of claim 1, wherein the temperature differential is between 20° F. and 40° F.

3. The unit of claim 1, wherein the temperature differential is between 30° F. and 40° F.

4. The unit of claim 1, wherein the first temperature zone is between 33° F. and 60° F. and the second temperature zone is between −10° F. and 10° F.

5. The unit of claim 1, wherein the first drawer cavity is vertically above the second drawer cavity and wherein the first temperature zone is at a higher temperature than the second temperature zone.

6. The unit of claim 5, wherein the first temperature zone is above the freezing point of water and the second temperature zone is below the freezing point of water.

7. The unit of claim 1, wherein one of the first and second temperature zones is above the freezing point of water and the other of the first and second temperature zones is below the freezing point of water.

8. The unit of claim 1, wherein the chimney extends to opposite sides of the partition between the first and second drawer cavities.

9. The unit of claim 8, wherein the chimney is non-dampered such that the first and second temperature zones remain in communication.

10. The unit of claim 8, wherein the air circulation system includes an air mover for directing air through the chimney.

11. The unit of claim 1, further including an ice maker disposed in one of the first and second drawer cavities.

12. The unit of claim 11, further including an ice bin mounted within one of the first and second drawers below the ice maker.

13. The unit of claim 10, wherein the ice maker is disposed in the second drawer cavity which is vertically below the first drawer cavity.

14. The unit of claim 1, wherein the evaporator is disposed in one of the first and second drawer cavities.

15. The unit of claim 1, wherein the chimney is disposed at a rear of the interior and the opening defining the return path is at a front portion of the partition.

16. A drawer refrigerator/freezer unit, comprising:

a refrigeration system having an evaporator, a compressor receiving return refrigerant from the evaporator and a condenser coupled to the compressor and to the evaporator through a restriction;

a cabinet having an interior in which the evaporator is mounted to cool two drawer cavities which define a refrigerator zone in which the temperature is maintained above the freezing point of water and a freezer zone in which the temperature is maintained below the freezing point of water;

a partition in the cabinet interior between the drawer cavities;

two drawers slidably mounted to the cabinet in the drawer cavities; and an air circulation system within the cabinet interior for communicating air between the refrigerator zone and the freezer zone, wherein the air circulation system has a circulation path formed by a chimney and a return path formed by an opening in the partition.

17. The unit of claim 16, wherein the refrigerator zone is between 33° F. and 60° F. and the freezer zone is between −10° F. and 10° F.

18. The unit of claim 16, wherein a temperature differential of at least 10° F. exists between the refrigerator zone and the freezer zone.

19. The unit of claim 16, wherein the refrigerator zone is vertically above the freezer zone.

20. The unit of claim 16, wherein the air circulation system includes an air mover directing air through the chimney.

21. The unit of claim 20, wherein the air chimney is damperless such that the refrigerator zone remains in communication with the freezer zone.

22. The unit of claim 16, wherein the evaporator is disposed only one of the first and second drawer cavities.

23. The unit of claim 16, further including an ice maker in the freezer zone.

24. The unit of claim 23, further including an ice bin mounted within one of the drawers associated with the freezer zone.

* * * * *